US005476412A

United States Patent [19]

Stoltz

[11] Patent Number: 5,476,412

[45] Date of Patent: Dec. 19, 1995

[54] BLADE AND WHEEL PLATE FOR BLAST CLEANING WHEEL AND METHOD OF CONNECTING A BLADE TO THE WHEEL PLATE

[75] Inventor: Edward J. Stoltz, Toronto, Canada

[73] Assignee: Blast Cleaning Products Ltd., Oakville, Canada

[21] Appl. No.: 303,753

[22] Filed: Aug. 18, 1994

[30] Foreign Application Priority Data

Jun. 22, 1994 [CA] Canada ..... 2126501

[51] Int. Cl.[6] ..... B24C 3/00

[52] U.S. Cl. ..... 451/75; 451/98; 451/97; 451/95

[58] Field of Search ..... 451/75, 91, 98, 451/97, 94, 95, 96; 416/214 A, 214 R, 219 R, 220 R; 29/525, 597

[56] References Cited

U.S. PATENT DOCUMENTS

| | | | |
|---|---|---|---|
| 2,204,635 | 6/1940 | Turnbull | 451/98 |
| 2,286,754 | 6/1942 | Minich | 451/95 |
| 2,295,926 | 9/1942 | Boesger | 451/95 |
| 2,869,289 | 1/1959 | Gossard | 451/97 |
| 3,348,339 | 10/1967 | Bowling, Jr. | 451/97 |
| 4,207,712 | 6/1980 | Toedtli | 451/98 |
| 4,333,278 | 6/1982 | Schulte et al. | 451/97 |
| 4,447,993 | 5/1984 | Laido | 451/97 |
| 4,473,972 | 10/1984 | Leliaert | 451/98 |
| 5,081,801 | 1/1992 | Fylak | 451/97 |
| 5,209,024 | 5/1993 | Carpenter et al. | 451/97 |
| 5,425,622 | 6/1995 | Murray | 416/219 R |

OTHER PUBLICATIONS

Blast Cleaning Products Ltd., "Wire Mesh Conveyor Blast Machines", whole document (undated).

Blast Cleaning Products Ltd., "Four Wheel Wire Mesh Conveyor Blast Machine", whole document (undated).

*Primary Examiner*—Bruce M. Kisliuk
*Assistant Examiner*—Derris Banks
*Attorney, Agent, or Firm*—Riches, McKenzie & Herbert

[57] ABSTRACT

This invention relates to a method of releasably connecting a blade to a single wheel plate of a centrifugal blasting wheel without using a separate stop-member to prevent outward radial movement of the blade. An alternative method of releasably connecting a blade to a wheel plate, and an alternative blade, wheel plate and blasting wheel are provided. The invention is useful in releasably aligning blades without the use of stop members. The blade can be accurately aligned in the channel of the wheel plate as a result of positive abutment of the sides of a wedge on the blade against the sides of the channel.

33 Claims, 7 Drawing Sheets

BLADE AND WHEEL PLATE FOR BLAST CLEANING WHEEL AND METHOD OF CONNECTING A BLADE TO THE WHEEL PLATE

BACKGROUND OF THE INVENTION

This invention relates to a method of releasably connecting a blade to a single wheel plate of a centrifugal blasting wheel without using a separate stop-member to prevent outward radial movement of the blade. The invention also relates to a blade adapted to be releasably connected to the single wheel plate and a centrifugal blasting wheel having a blade releasably connected in accordance with the teaching of the method aspect of the invention.

Centrifugal blasting wheels have been known for some time. In essence, abrasive material is supplied to a rotating blasting wheel, usually from a central area of the wheel. The abrasive is directed against an object to be cleaned by a plurality of blades which radiate outwardly from the central area of the blasting wheel and which rotate as the wheel rotates. Typically, the blades are connected to one or two annular wheel plates. Many methods have been devised to connect the blades to one or more wheel plates.

One such connecting method is disclosed in U.S. Pat. No. 2,869,289. In accordance with that prior art method, a connecting member extends from one side edge of the blade and the connecting member is slidable into a corresponding channel in the face of the annular wheel plate. In one form, the connecting member in the prior art was a dovetail-shaped member in cross-section and the cross-section remained a uniform size throughout. In essence, the side faces of the dovetail connecting member were in radial planes. Also, the side faces of the dovetail connecting member corresponded to side faces in the corresponding channel in the annular wheel plate.

One of the difficulties with this prior art connecting method was that in order to prevent the blade from moving radially outwardly some form of stop member was used which was inserted into or through the wheel plate to prevent the blade from moving radially outwardly. As the wheel rotated, the blade moved radially outwardly until it abutted against the stop member and the stop member prevented further outward radial movement. The difficulty with the stop members was that they tended to wear more quickly than other parts of the wheel and blades and, therefore, had to be replaced more frequently.

In addition to stopping the blade from further outward radial movement, the stop members is used to properly position the blades so that all of the blades in the wheel, which are substantially identical, are positioned the same distance from the centre of wheel so that the mass of the wheel is balanced and the wheel rotates properly because the stop member wears more easily than other parts of the wheel, if these pins are not changed on a timely basis, one blade may advance further into the channel than intended. If the blade diametrically opposite to this blade which has advanced more than planned into the channel has not so advanced, there will be a mass imbalance on the wheel which will cause problems with proper rotation.

Because the blades were typically cast and not ground, the tolerances were such that there was a gap between the two side faces. In order that the blade could be slid readily into the channel, it was necessary that there be some gap between the two side faces. Therefore, another difficulty with the prior art connecting methods was that, during operation, abrasive shot would become lodged in the space or gap between the side face of the connecting member of the blade and the side face of the channel in the wheel plate.

After the blade had been inserted and the apparatus had been in operation for some time, the abrasive which became lodged between the blade and the channel made the blade extremely difficult to remove. It is necessary to remove the blades relatively frequently because the blades wear more frequently than other parts of the wheel because of a constant contact with abrasives.

In order to remove a prior art blade when abrasive is lodged between the blade and the channel, it was necessary to apply a sufficient striking force against the outer end of the blade, such as with a hammer, to move the blade inwardly along the entire length of the channel. This task is difficult and dangerous. It is dangerous because the blades are relatively hard and brittle. As a result of the hammering, often a chip will be chipped from the end of the blade. If the chip is not recovered there is a possibility that it will find its way into the other working parts of the wheel. Because it is so hard, the chip may damage other parts of the blasting wheel.

Another difficulty with the prior art connecting blades is that, because of the tolerances as a result of casting, the channel slot is larger than the blade connecting member. This results in a sloppy fit between the blade and channel. This sloppiness means that the blades do not always square with the face of the wheel plate and can be two or three degrees off square. This means that the shot is not thrown properly in a plane parallel to the face plate and all of the abrasive will not correctly strike the object to be cleaned.

SUMMARY OF THE INVENTION

Accordingly, it is an object of this invention to at least partially overcome the disadvantages of the prior art.

Accordingly, in one of its broad aspects, this invention resides in providing a method of releasably connecting a blade to a single wheel plate of a centrifugal blasting wheel without using a separate stop-member to prevent outward radial movement of the blade, comprising:

inserting the blade into the wheel from an inner, central region of the wheel;

releasably sliding the blade radially outwardly into a radial channel in an inner face of the single wheel plate;

wherein the wheel plate is annular and has an inner periphery and an outer periphery;

wherein the channel has an opening extending radially along the inner face of the wheel plate and the opening has a width, the channel has a bottom extending radially in the wheel plate and the bottom has a width, and the channel has two side faces and corresponding locations on each side face are separated by a channel width;

wherein the channel extends radially from the inner periphery of the wheel plate to at least a region intermediate of the inner periphery and the outer periphery of the wheel plate;

wherein the channel has a cross-sectional shape and, at each of a first region along the channel and at a second region along the channel that is separated radially from the first region, the cross-sectional shape of the channel is such that the width of the opening is less than the width of the bottom so as to prevent a corresponding, fully-inserted blade from moving transversely to the face of the wheel plate;

wherein, in the first and second regions, the channel width is narrower at locations further from the inner periphery of the wheel plate;

wherein the blade has a connecting means extending radially along one side edge of the blade to slidably engage with the channel; and wherein the blade connecting means corresponds in cross-sectional shape and width to the cross-sectional shape and width of the channel, and wherein the connecting means has two side faces corresponding to the two side-faces of the channel; and causing the two side faces of the blade to abut against the two corresponding side faces of the channel, in the first and second regions, so as to prevent outward radial movement of the corresponding blade without an additional stop-member.

Further aspects of the invention reside in providing a blade, wheel plate and centrifugal blasting wheel having characteristics such that the method can be implemented.

Further aspects of the invention will become apparent upon reading the following detailed description and the drawings which illustrate the invention and preferred embodiments of the invention.

DETAILED DESCRIPTION OF PREFERRED EMBODIMENTS OF THE INVENTION

Figure 1:
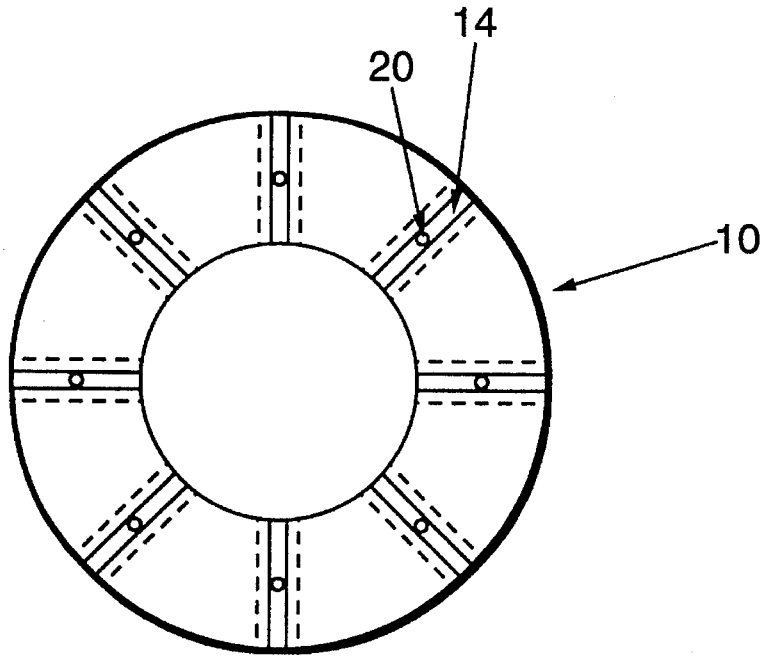
FIG.1. PRIOR ART
FIG. 1 is a front view of a prior art wheel plate.
Figure 2:
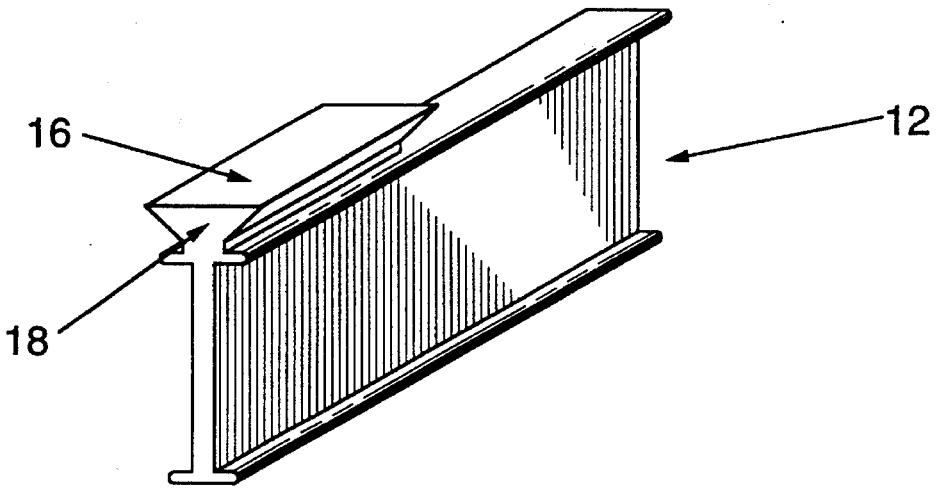
FIG.2. PRIOR ART
FIG. 2 is a perspective view of a prior art blade.

A typical form of a prior art wheel plate 10 is shown in FIG. 1 with a corresponding typical prior art blade 12 shown in FIG. 2. The wheel plate 10 has typically eight radial channels 14 equally spaced around the wheel plate 10. The blade 12 has a connecting member 16 along one side edge of the blade 12. The blade connecting member 16 has a cross-sectional shape 18 which is dovetailed and remains constant in size and shape along the entire length of the connecting member.

The blade 12 is typically inserted from the inner central portion of the wheel plate 10. Outward radial movement of the blade 12 beyond a desired distance is stopped by a stop member 20.

A typical stop member 20 is a cap screw or bolt which is screwed into the channel 14 of the wheel plate 10 from the side of the wheel plate 10 having the channels 14.

Figure 3:
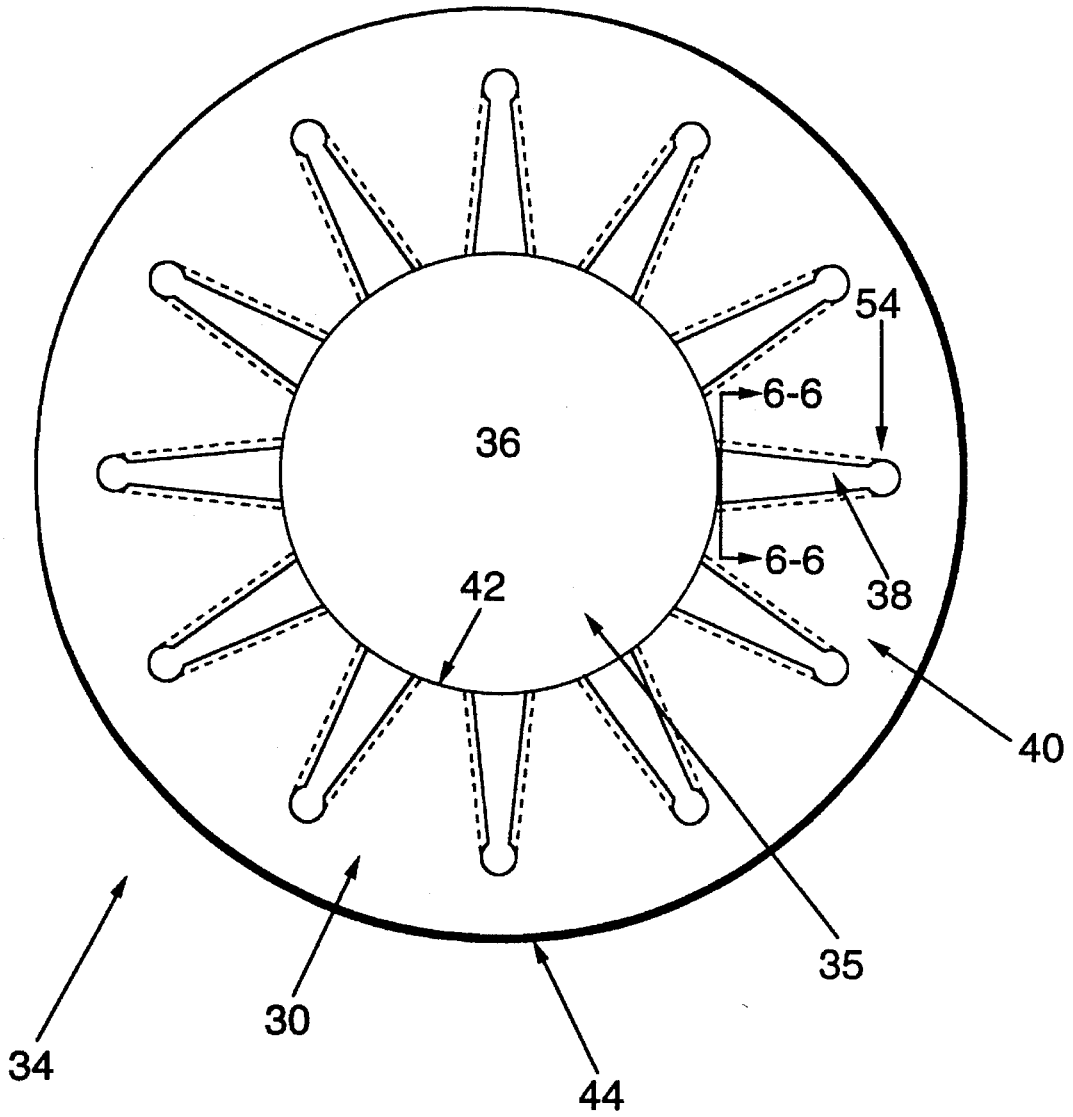
FIG. 3 is a front view of a preferred embodiment of a wheel plate of the invention.

A preferred embodiment of the wheel plate of the invention is shown in FIG. 3. The wheel plate 30 is substantially the same as prior art wheel plates (except for the changes described herein) and the wheel itself is the same (except for the changes described herein) and has the same operation as prior art blasting wheels. The differences arise in the method of connecting the blades 32 (as shown in FIG. 4) to the wheel plate 30.

Figure 5:
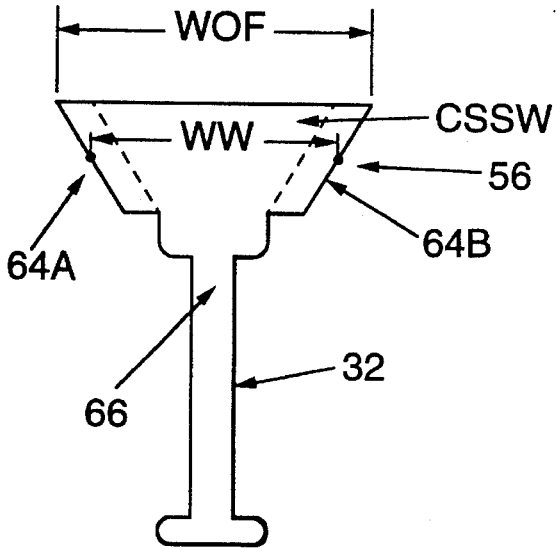
FIG. 5 is an end view of a preferred embodiment of a blade of the invention.

An end view of the blade 32 from the inner end 66 of the blade 32 is shown in FIG. 5.

Figure 4:
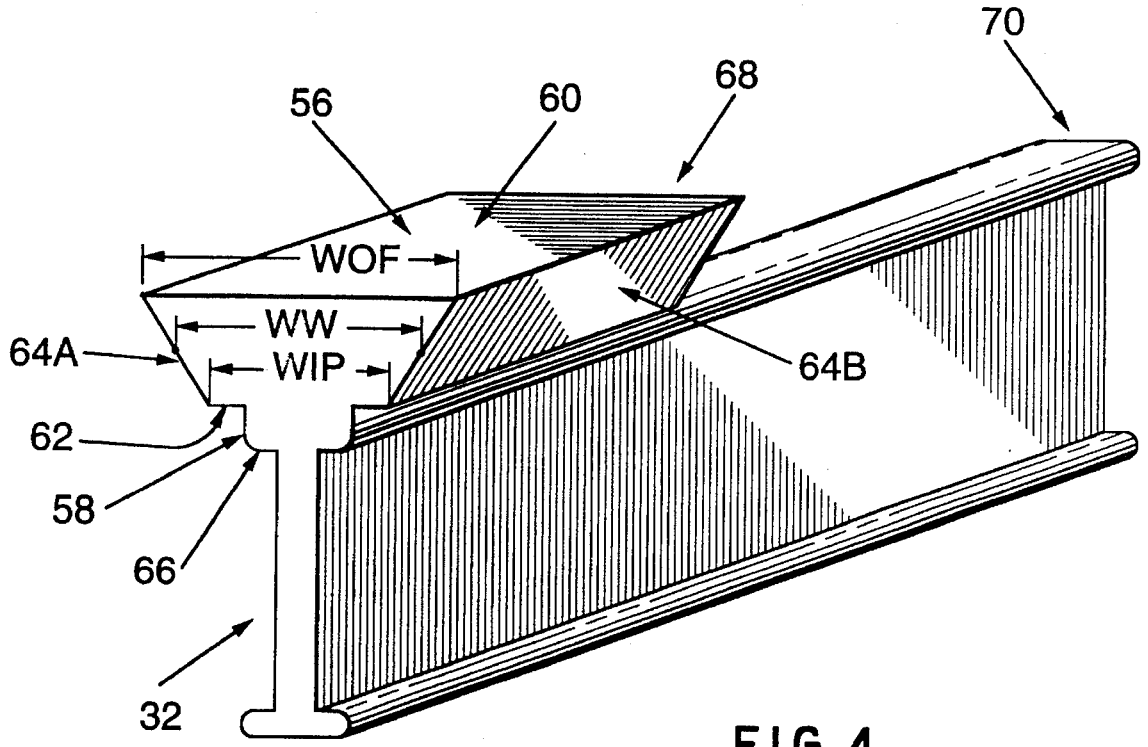
FIG. 4 is a perspective view of preferred embodiment of a blade of the invention.

One aspect of the invention is a method of releasably connecting a blade, a preferred embodiment of which is shown in FIGS. 4 and 5, to a single wheel plate 30 of a centrifugal blasting wheel without using a separate stop-member to prevent outward radial movement of the blade. The method comprises inserting the blade 32 into the wheel 34 from an inner central region 36 of the wheel 34. Typically an additional plate 35 will fit into the inner central region 36 of the wheel 34 to prevent the inward radial movement of the blades 32 after they have been inserted into channels 38.

The next step in the method is to releasably slide the blade 32 radially outwardly into the radial channel 38 in the inner face 40 of the single wheel plate 30.

The wheel plate 30 is annular and has an inner periphery 42 and an outer periphery 44. The additional plate 35 fits into the inner annular portion of the wheel plate 30.

Figure 6:
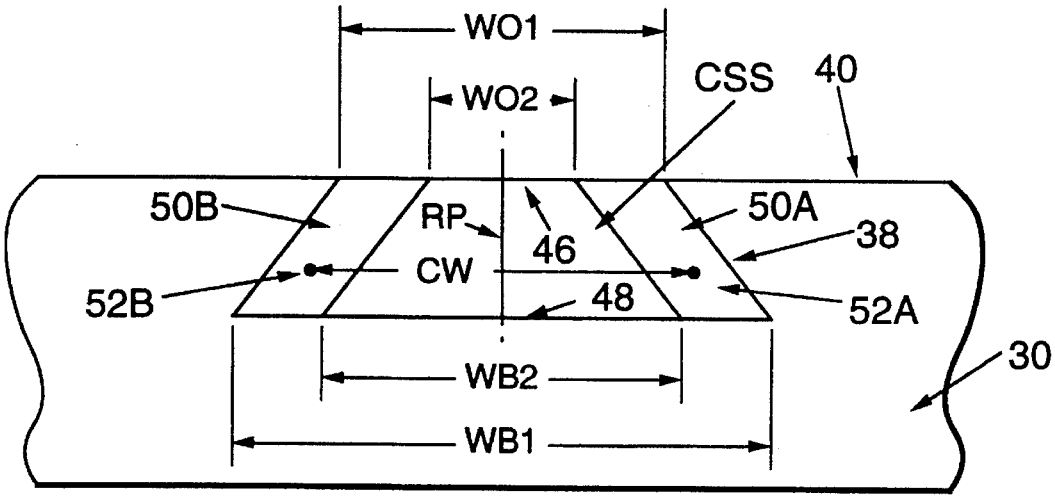
FIG. 6 is a cross-sectional view of a preferred embodiment of a channel of the invention.

Looking in cross-section into the channel 38 as shown in FIG. 6, the channel 38 has an opening 46 which can be considered to be parallel with, or an extension of, the inner face 40. The opening 46 extends radially along the inner face 40 of the wheel plate 30. The opening 46 has a width W0. At the inner periphery 42 of the face plate 40 the width W0 of the opening 46 is W01. The width W of the opening 46 at the effective end of the channel 46 is W02.

The channel 38 also has a bottom 48. The bottom 48 has a width WB. At the inner periphery 42 of the wheel plate 30 the width WB of the bottom 48 is WB1 and the width WB of the bottom 48 at the effective end of the channel 38 is WB2.

The channel 38 has two side faces 50A and 50B. Corresponding locations, such as 52A and 52B, on each respective side face 50A and 50B are separated by a channel width WC.

The channel 38 extends radially from the inner periphery 42 of the wheel plate 30 to at least a region 54 intermediate of the inner periphery 42 and the outer periphery 44 of the wheel plate 30. It is possible that the channel 38 could extend the entire distance from the inner periphery 42 to the outer periphery 44 of the wheel plate 30.

As best shown in FIG. 6, the channel 38 has a cross-sectional shape CSS. Preferably that cross-sectional shape CSS remains constant in shape throughout the entire length of the channel 38, although the size of the cross-section of the channel 38 will vary along the length of the channel 38.

The cross-sectional shape CSS of the channel 38 is such that the width W0 of the opening 46 is less than the width WB of the bottom 48 so as to prevent a corresponding, fully-inserted blade 32 from moving transversely to the face 40 of the wheel plate 30.

Figure 7:
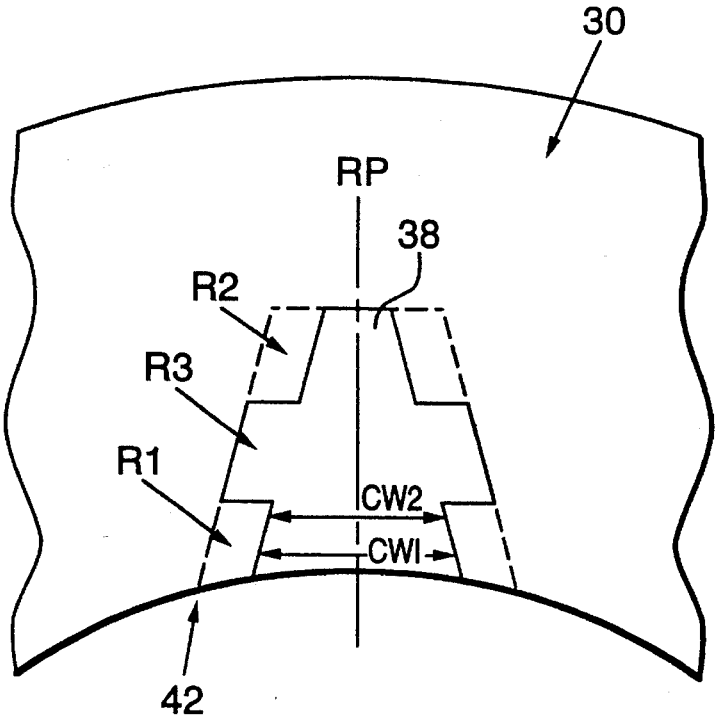
FIG. 7 is a top view of a preferred embodiment of a channel of the invention.

Preferably the channel 38 has the cross-sectional-shape as described in the paragraph immediately above throughout the entire length of the channel 38. However, the channel 38 need only have this cross-sectional shape at each of a first region R1 (as best seen in FIG. 7) and at a second region R2 that is separated radially from the first region R1. In this embodiment, the region R3 between the two regions R1 and R2 does not have the cross-sectional shape as described in the paragraph immediately above. As shown in FIG. 7, the cross-sectional shape in the region R3 could be rectangular for example, whereas the cross-sectional shape in the regions R1 and R2 is dovetailed. In the regions other than R1 and R2, it is understood that outward radial movement of the blade 32 is not impeded.

In a most preferred embodiment, the first and second regions R1 and R2 of the channel 38 are contiguous and extend from the inner periphery 42 of the wheel plate 30 to a location corresponding to an effective length of the blade connecting means 56. By the effective length of the blade connecting means 56 it is meant the length of the blade connecting means 56 which is effective in connecting the blade 32 to the wheel plate 30.

The cross-sectional shape CSS of the channel 38, as shown in FIG. 7, may be dovetailed only in the regions R1 and R2. However, it is preferred that the cross-sectional shape CSS of the channel 38 be dovetailed throughout the entire effective length of the channel, as shown in FIGS. 3 and 6. Thus, it is preferred that the cross-sectional shape (but not size) of the channel 38 is the same at all locations along the channel 38, and it is preferred that that cross-sectional shape CSS is dovetailed.

Figure 8A:
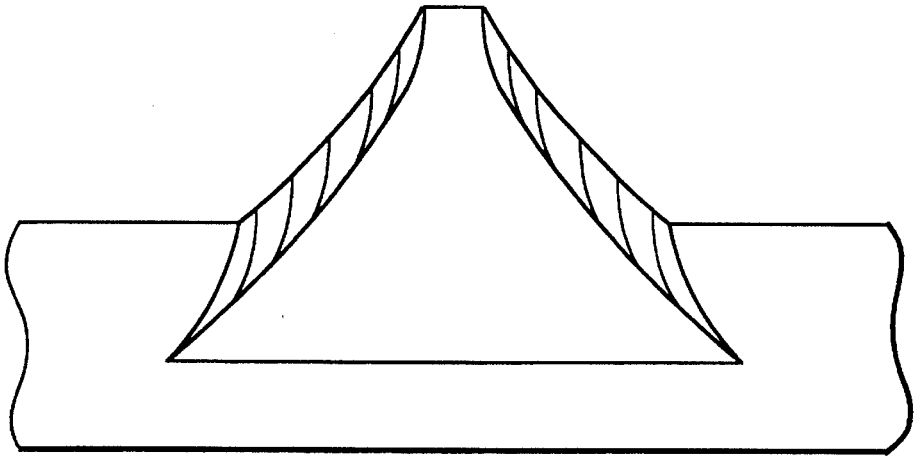
FIG. 8A is an end view of a preferred embodiment of a channel of the invention.
Figure 8B:
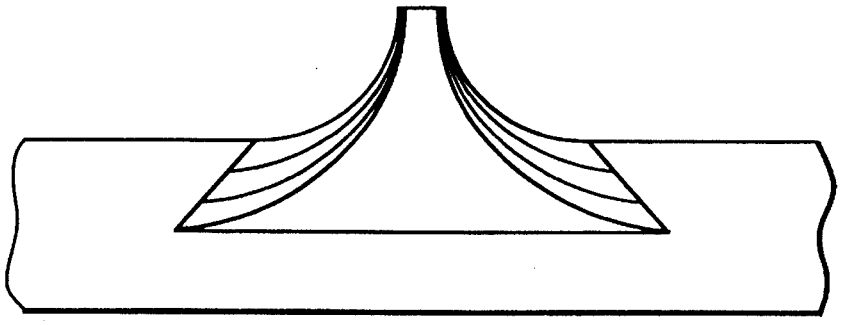
FIG. 8B is a preferred embodiment of a channel of the invention.
Figure 8C:
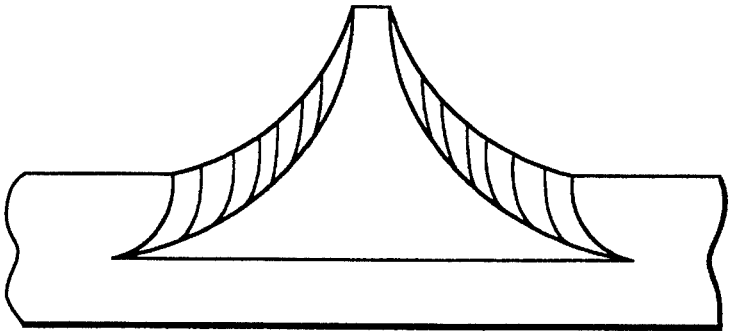
FIG. 8C is a preferred embodiment of a channel of the invention.

Although it is preferred that the side faces 50A and 50B of the channel 38, in at least the first and second regions R1 and R2, and more preferably along the entire length of the channel 38, are straight and flat, it is possible that the side faces 50A and 50B may be curved in one or both planes, as shown schematically in FIGS. 8A, 8B and 8C.

Preferably the bottom 48 of the channel 38 is parallel to the face 40 of the wheel plate 30. However, it is possible that the bottom 48 of the channel 38 be in a plane which is non-parallel to the face 40 of the wheel plate 30.

Figure 9:
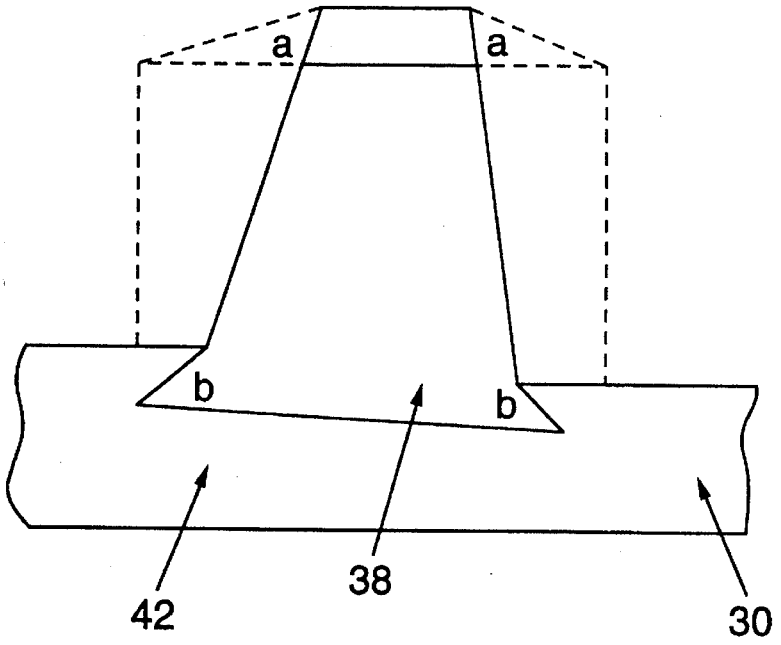
FIG. 9 is a schematic, perspective view of a preferred embodiment of a channel of the invention.

As noted, it is preferred that the cross-sectional shape CSS of the channel 38 be the same at all locations along the channel. However, the invention does include those embodiments where the cross-sectional shape varies along locations along the channel 38 such as shown schematically in FIG. 9. In FIG. 9, the angle of the dovetail is "b" at the inner periphery 42 of the wheelplate 30. Whereas, at the end of the channel 38 the angle of the dovetail is "a" which is less than the angle b. In this embodiment, the width WB of the bottom 48 of the channel remains uniform, but the width W0 of the opening 46 of the channel becomes constantly smaller at locations further from the inner periphery 42 of the wheel plate 30.

Figure 10:
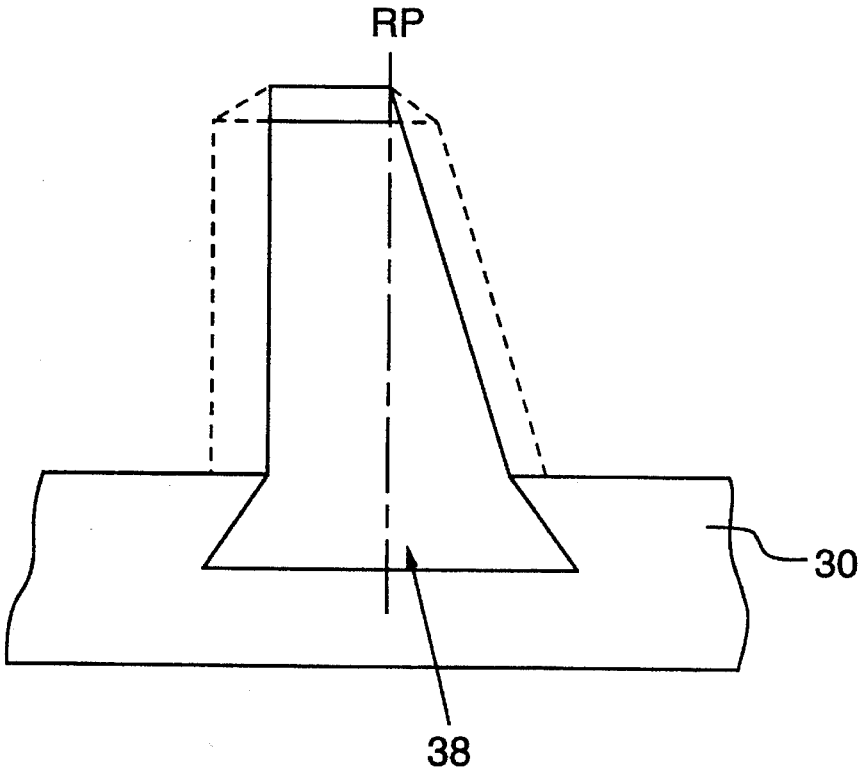
FIG. 10 of a schematic, perspective view of a preferred embodiment of a channel of the invention.

Preferably the channel 38 is symmetrically aligned about a radial plane RP transverse to the face 40 of the wheel plate 30 as illustrated in FIGS. 6 and 7. However, it is possible that the channel 38 may be asymmetrical about the radial plane RP as shown schematically in FIG. 10.

In at least the first and second regions R1 and R2, the channel width CW is narrower at locations further from the inner periphery 42 of the wheel plate 30. Thus, for example, in FIG. 7, the channel width CW2, which is at a location further from the inner periphery 42 than the channel 38 at channel width CW1, is narrower than the channel width CW1. A similar relationship is found in the region R2. Similarly, when the regions R1 and R2 are contiguous, the channel width CW at any location further from the inner periphery 42 is narrower than at those locations closer to the inner periphery 42.

As noted previously, and as illustrated in FIGS. 4 and 5, the blade 32 has a connecting means 56 which extends radially along one side edge 58 of the blade 32 to slidably engage with the channel 38. The blade connecting means 56 corresponds in cross-sectional shape and width to the cross-sectional shape and width of the channel 38 at various corresponding locations along the effective lengths of the channel 38 and the blade connecting means 56. Thus, if the blade connecting means 56 is considered to be a blade connecting wedge 56 extending radially along one side edge 58 of the blade 32, the wedge 56 has an outer face 60 extending radially and the outer face 60 of the wedge 56 has a width W0F. The width W0F of the wedge 56 corresponds to the width W0 of the opening 46 of the channel 38 at various corresponding locations along the effective lengths of the channel 38 and the wedge 56.

Similarly, the wedge 56 has an inner portion 62 extending radially. The inner portion 62 has a width WIP and the width WIP corresponds to the width WB of the bottom 48 of the channel 38 at various corresponding locations along the effective lengths of the channel 38 and the wedge 56.

Similarly, the wedge 56 has two side faces 64A and 64B which correspond to the side faces 50A and 50B of the channel 38 at various corresponding locations along the effective lengths of the channel 38 and the wedge 56.

Corresponding locations on each side face 64A, 64B are separated by a width WW.

The wedge 56 extends radially from an inner end 66 of the blade 32 to a region 68 intermediate of the inner end 66 and an outer end 70 of the blade 32.

The wedge 56 has a cross-sectional shape CSSW. The cross-sectional shape CSSW of the wedge 56 is such that the width WIP of the inner portion 62 is less than the width W0F of the outer face 60 so as to prevent a fully-engaged blade 32 in a correponding radial channel 38 from moving transversely to the inner face 40 of the wheel plate 30.

The wedge 56 corresponds in cross-sectional shape CSSW and width to a cross-sectional shape CSS and width of the channel 38. Thus, in regions of the wedge 56 which correspond to the first and second regions R1, R2 of the channel 38, the wedge width WW is narrower at locations further from the inner end 66 of the blade 32.

Also, the two side faces 64A and 64B of the wedge 56 correspond to the two side faces 50A and 50B of the channel 38 such that, when fully engaged, the two side faces 64A and 64B of the wedge 56, in at least the corresponding first and second regions R1 and R2, abut against the two corresponding side faces 50A and 50B in the first and second regions R1 and R2 so as to prevent outward radial movement of the blade 32 in the corresponding channel 38 without an additional stop member, such as used in the prior art and as shown as capscrew 20 in FIG. 1.

Figure 11:
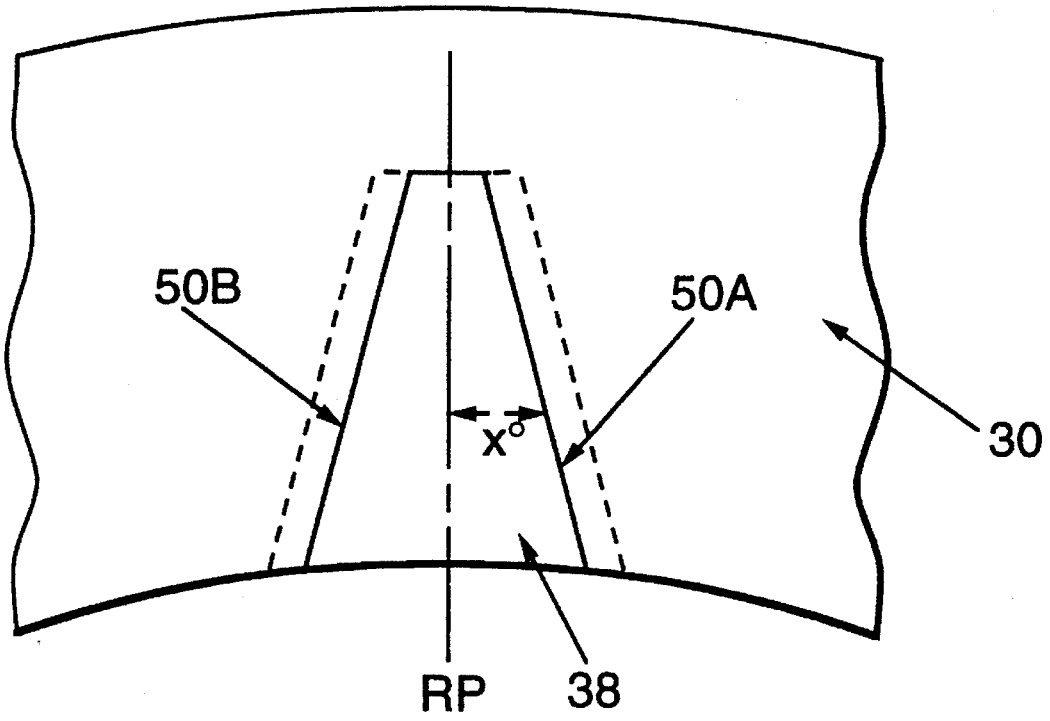
FIG. 11 is a top view of a preferred embodiment of a channel of the invention.

Preferably each side face 50A, 50B of the channel 38 and each side face 64A, 64B of a corresponding wedge 56, is aligned at an angle in a range of about 3 to 5 degrees, and preferably 4 degrees, from the radial plane RP as illustrated in FIG. 11. In FIG. 11, this angle is shown as angle "x".

Figure 12:
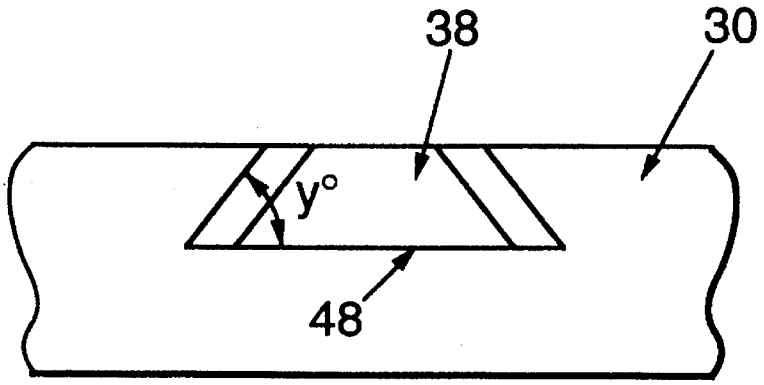
FIG. 12 is an end view of a preferred embodiment of the invention.

Also, preferably, each side face 50A, 50B of the channel 38, and each corresponding side face 64A, 64B of the wedge 56, is aligned at an angle in a range of about 55 to 65 degrees, and preferably 60 degrees, from the plane of the bottom 48 of the channel 38, or the outer face 60 of the wedge 56. This angle is shown as angle "y" in FIG. 12.

Preferably there are twelve channels 38 equally-spaced around the wheel plate 30 as shown in FIG. 3. Although prior art devices usually have only eight channels or blades, it has been discovered that by using twelve blades 32 equally-spaced around the wheel plate 30, better balancing and rotation of the wheel 34 can be achieved.

Preferably the side faces 50A, 50B of the channels 38 and the side faces 64A, 64B of the wedges 56 are ground to relatively close tolerances. When the various faces are ground, the blades 32 can be inserted more exactly into the channels 38 so as to reduce the sloppiness of the fit. This results in at least two advantages. Firstly, when the side faces 64A, 64B of the wedge 56 abut against the corresponding side faces 50A, 50B of the channel 38, there is a snug fit which prevents movement of the blade in a direction transverse to the radial plane RP. This means that there is less canting of the blades 32 and, therefore, the blades 32 propel the abrasive shot in a direction which is closer to being parallel with the inner face 40 of the wheel plate 30 than prior art devices.

Secondly, when the side faces 64A, 64B of the wedge abut against the corresponding side faces 50A, 50B of the channel the blade is positively prevented from further outward radial movement.

Thus, by properly selecting the shape and size of the wedge 56 to correspond to the shape and size of the channel 38, the blade 32 is made to stop at an exact predetermined location from the centre of the wheel 34. Thus, the inner end 66 of the blade 32 is caused to be positioned in alignment with the inner periphery 42 of the wheel plate 30. There is extremely little wear of the side faces 50 of the channel and side faces 64 of the wedge, certainly compared to the wear of a stop member 20 of the prior art. Therefore, after the blades 32 have been inserted, the location of the blade 32 with respect to the wheel plate 30 do not vary and, therefore, the wheel 34 remains properly balanced and rotates properly.

One further advantage of the invention is that the blade 32 is easily releasable from the channel 38. Once the blade 32 has been initially loosened such that the side faces 64 of the wedge 56 no longer abut against the side faces 50 of the channel 38, the blade 32 virtually drops out of the channel 38.

A further aspect of the invention is a centrifugal blasting wheel comprising a wheel plate 30 as described herein having connected thereto blades 32 as described herein.

Although this disclosure has described and illustrated certain preferred embodiments of the invention as it relates to variations of the channels 38 in the wheel plate 30, the various embodiments and description apply as well to embodiments of the blade 32. The important feature is that the side faces 64 of the wedge 56 of the blade 32 abut against the side faces 50 of the channel, in at least two regions R1 and R2, so as to prevent outward radial movement of the blade.

The invention also includes as an additional aspect any appropriate combination of blades 32 and channels 38 to form a suitable blasting wheel 34.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

The embodiments of the invention in which an exclusive property or privilege is claimed are defined as follows:

1. A method of releasably connecting a blade to a single wheel plate of a centrifugal blasting wheel without using a separate stop-member to prevent outward radial movement of the blade, comprising:

inserting the blade into the wheel from an inner, central region of the wheel;

releasably sliding the blade radially outwardly into a radial channel in an inner face of the single wheel plate;

wherein the wheel plate is annular and has an inner periphery and an outer periphery;

wherein the channel has an opening extending radially along the inner face of the wheel plate and the opening has a width, the channel has a bottom extending radially in the wheel plate and the bottom has a width, and the channel has two side faces and corresponding locations on each side face are separated by a channel width;

wherein the channel extends radially from the inner periphery of the wheel plate to at least a region intermediate of the inner periphery and the outer periphery of the wheel plate;

wherein the channel has a cross-sectional shape and, at each of a first region along the channel and at a second region along the channel that is separated radially from the first region, the cross-sectional shape of the channel is such that the width of the opening is less than the width of the bottom so as to prevent a corresponding, fully-inserted blade from moving transversely to the face of the wheel plate;

wherein, in the first and second regions, the channel width is narrower at locations further from the inner periphery of the wheel plate;

wherein the blade has a connecting means extending radially along one side edge of the blade to slidably engage with the channel; and wherein the blade connecting means corresponds in cross-sectional shape and width to the cross-sectional shape and width of the channel, and wherein the connecting means has two side faces corresponding to the two side-faces of the channel; and causing the two side faces of the blade to abut against the two corresponding side faces of the channel, in the first and second regions, so as to prevent outward radial movement of the corresponding blade without an additional stop-member.

2. A method as defined in claim 1 wherein the cross-sectional shape of the channel in the first and second regions is a dovetail shape.

3. A method as defined in claim 2 wherein the side faces of the channel in the first and second regions are straight and flat.

4. A method as defined in claim 3 wherein the channel is symmetrically aligned about a radial plane transverse to the face of the wheel plate.

5. A method as defined in claim 4 wherein the bottom of the channel is parallel to the face of the wheel plate.

6. A method as defined in claim 5 wherein the first and second regions of the channel are contiguous and extend from the inner periphery of the wheel plate to a location corresponding to an effective length of the blade connecting means.

7. A method as defined in claim 6 wherein the cross-sectional shape of the channel is the same at all locations along the channel.

8. A method as defined in claim 7 wherein each side face of the channel is aligned at an angle in the range of about 3 to 5 degrees from the radial plane.

9. A method as defined in claim 8 wherein each side face of the channel is aligned at an angle in the range of about 55 to 65 degrees from the plane of the bottom of the channel.

10. A method as defined in claim 9 wherein each side face of the channel and each side face of the blade if ground.

11. A method as defined in claim 10 wherein there are twelve channels equally-spaced around the wheel plate.

12. A centrifugal blasting wheel comprising:

an annular wheel plate having an inner face, an inner periphery and an outer periphery;

a plurality of radially extending channels which are equally spaced around the wheel plate;

a blade releasably inserted into each channel;

wherein each channel has an opening extending radially along the inner face of the wheel plate and the opening has a width, each channel has a bottom extending radially in the wheel plate and the bottom has a width, and each channel has two side faces and corresponding locations on each side face are separated by a channel width;

wherein each channel extends radially from the inner periphery of the wheel plate to at least a region intermediate of the inner periphery and the outer periphery of the wheel plate;

wherein each channel has a cross-sectional shape and, at each of a first region along the channel and at a second region along the channel that is separated radially from the first region, the cross-sectional shape of the channel is such that the width of the opening is less than the width the bottom so as to prevent a corresponding, fully-inserted blade from moving transversely to the face of the wheel plate;

wherein, in the first and second regions of each channel, the channel width is narrower at locations further from the inner periphery of the wheel plate;

wherein each blade has a connecting means extending radially along one side edge of the blade to slidably engage with the corresponding channel; and wherein each blade connecting means corresponds cross-sectional shape and width to the cross-sectional shape and width of the corresponding channel;

wherein each connecting means has two side faces corresponding to the two side faces of the corresponding channel such that when the two side faces of the blade connecting means abut against the two corresponding side faces of the corresponding channel, in the first and second regions, outward radial movement of the corresponding blade is prevented without an additional stop-member.

13. A blasting wheel as defined in claim 12 wherein the cross-sectional shape of each channel in the first and second regions is a dovetail shape.

14. A blasting wheel as defined in claim 13 wherein the side faces of each channel in the first and second regions are straight and flat.

15. A blasting wheel as defined in claim 14 wherein each channel is symmetrically aligned about a radial plane transverse to the face of the wheel plate.

16. A blasting wheel as defined in claim 15 wherein the bottom of each channel is parallel to the face of the wheel plate.

17. A blasting wheel as defined in claim 16 wherein the first and second regions of each channel are contiguous and extend from the inner periphery of the wheel plate to a location corresponding to an effective length of the corresponding blade connecting means.

18. A blasting wheel as defined in claim 17 wherein the cross-sectional shape of each channel is the same at all locations along the respective channel.

19. A blasting wheel as defined in claim 18 wherein each side face of each channel is aligned at an angle in the range of about 3 to 5 degrees from the radial plane.

20. A blasting wheel as defined in claim 19 wherein each side face of each channel is aligned at an angle in the range of about 55 to 65 degrees from the plane of the bottom of the channel.

21. A blasting wheel as defined in claim 20 wherein there are twelve channels equally-spaced around the wheel plate.

22. A blasting wheel as defined in claim 21 wherein each side face of the channel and each side face of the blade is ground.

23. A blade releasably-connectable to a single wheel plate of a centrifugal blasting wheel without using a separate stop-member to prevent outward radial movement of the blade, comprising:

a blade-connecting wedge extending radially along one side edge of the blade to slidably engage with a radial channel in an inner face of the single wheel plate;

wherein the wedge has an outer face extending radially and the outer face of the wedge has a width, the wedge has an inner portion extending radially and the inner portion has a width, and the wedge has two side faces and corresponding locations on each side face are separated by a wedge width;

wherein the wedge extends radially from an inner end of the blade to a region intermediate of the inner end and an outer end of the blade;

wherein the wedge has a cross-sectional shape and, at each of a first region along the wedge and at a second region along the wedge that is separated radially from the first region, the cross-sectional shape of the wedge is such that the width of the inner portion is less than the width of the outer face so as to prevent a fully-engaged blade in a corresponding radial channel from moving transversely to the face of the wheel plate;

wherein, in the first and second regions, the wedge width is narrower at locations further from the inner end of the blade;

wherein the wedge corresponds in cross-sectional shape and width to a cross-sectional shape and width of the channel; and wherein the two side faces of the wedge correspond to two side faces of the channel such that, when fully engaged, the first and second regions of the two side faces of the wedge abut against the two corresponding side faces of the channel so as to prevent outward radial movement of the blade in the corresponding channel without an additional stop-member.

24. A blade as defined in claim 23 wherein the cross-sectional shape of the wedge in the first and second regions is a dovetail shape.

25. A blade as defined in claim 24 wherein the side faces of the blade in the first and second regions are straight and flat.

26. A blade as defined in claim 25 wherein the wedge is symmetrically aligned about a centre line along the side edge of the blade from which the wedge extends.

27. A blade as defined in claim 26 wherein the outer face of the wedge is parallel to the side edge of the blade.

28. A blade as defined in claim 27 wherein the first and second regions of the wedge are contiguous and extend from the inner end of the blade to a location corresponding to an effective length of the wedge.

29. A blade as defined in claim 28 wherein the cross-sectional shape of the blade is the same at all locations along the wedge.

30. A blade as defined in claim 29 wherein each side face of the wedge is aligned at an angle in the range of about 3 to 5 degrees from the centre line along the the side edge of the blade.

31. A blade as defined in claim 30 wherein each side face of the wedge is aligned at an angle in the range of about 55 to 65 degrees from the plane of the outer face of the wedge.

32. A blade as defined in claim 31 wherein each side face of the wedge is ground.

33. A blade as defined in claim 29 wherein there are twelve channels equally-spaced around the wheel plate.

* * * * *